United States Patent [19]

Matsuda

[11] 4,041,577

[45] Aug. 16, 1977

[54] STRINGER FOR SLIDING CLASP FASTENER

[75] Inventor: Yoshio Matsuda, Nyuzen, Japan

[73] Assignee: Yoshida Kogyo Kabushiki Kaisha, Japan

[21] Appl. No.: 661,023

[22] Filed: Feb. 24, 1976

[30] Foreign Application Priority Data

Feb. 28, 1975 Japan ..... 50-25366

[51] Int. Cl.[2] ..... A44B 19/12; A44B 19/02

[52] U.S. Cl. ..... 24/205.16 C; 24/205.1 C; 66/195

[58] Field of Search ..... 24/205.16 C; 66/195

[56] References Cited

U.S. PATENT DOCUMENTS

| | | | |
|---|---|---|---|
| 3,714,683 | 2/1973 | Frohlich | 24/205.16 C |
| 3,840,946 | 10/1974 | Frohlich | 24/205.16 C |

FOREIGN PATENT DOCUMENTS

| | | | |
|---|---|---|---|
| 2,016,140 | 10/1971 | Germany | 24/205.16 C |

*Primary Examiner*—Bernard A. Gelak
*Attorney, Agent, or Firm*—Bucknam and Archer

[57] ABSTRACT

A fastener stringer comprises a warp-knit tape and a row of interlocking fastener elements secured thereto. The tape has a web portion formed by chain stitches defining longitudinally extending wales, tricot stitches extending diagonally across and between a plurality of adjacent wales, and laid-in weft threads extending over and connecting every four wales. The tape also has a longitudinal edge portion consisting solely of knit-loop forming threads. Both of the portions are interconnected transversely of the tape by threads constituting the web portion and edge portion, respectively. One of the wales adjacent the longitudinal edge portion is biased toward the web portion to widen an interwale valley between the above-mentioned one of wales and its neighboring wale.

3 Claims, 5 Drawing Figures

STRINGER FOR SLIDING CLASP FASTENER

BACKGROUND OF THE INVENTION

This invention relates to a sliding clasp fastener and more particularly to a stringer of a warp-knit structure therefor which carries along one longitudinal edge a row of interlocking fastener elements.

Known warp-knit tapes for sliding clasp fasteners basically comprised chain stitches forming longitudinally extending wales and weft laid-in threads connecting these wales coursewise. A row of fastener elements was secured to a longitudinal selvage or edge portion of the tape by a line of stitching received in an interwale groove between an outermost wale and its neighbouring wale.

When thus securing the fastener elements to the tape edge, it is important to hold them stably in place against their displacement relative to the tape. With this in view, the present inventor has proposed in a copending application a fastener stringer comprising a warp-knit tape and a row of interlocking fastener elements mounted thereon, said tape having a web portion of a relatively coarse interstice structure, a longitudinal edge portion consisting solely of knit-loop forming threads for mounting said row of fastener elements, and a connecting portion of a relatively fine interstice structure interconnecting said web portion and said edge portion transversely of the tape, said connecting portion being formed by threads constituting said web portion and said edge portion, respectively.

SUMMARY OF THE INVENTION

The present invention is directed to an improvement in the above fastener stringer wherein the tape edge portion to which the fastener elements are to be secured is further contrived to achieve a first purpose of mounting a relatively large fastener element with two lines of stitching; i.e. a double sewn seam, and a second purpose of facilitating the attachment of top and bottom end stops.

Briefly stated, the above-noted purposes contemplated by the invention can be achieved by the provision of a fastener stringer which comprises a warp-knit tape and a row of interlocking fastener elements secured thereto, said tape having a web portion formed by chain stitches defining longitudinally extending wales, tricot stitches extending diagonally across and between a plurality of adjacent wales, and laid-in weft threads extending over and connecting every four wales and a longitudinal edge portion consisting solely of knit-loop forming threads, both of said portions being interconnected transversely of the tape by threads constituting said web portion and said edge portion, respectively, one of said wales adjacent said longitudinal edge portion being biased toward said web portion to widen an interwale valley between said one of wales and its neighbouring wale.

The invention however will be better understood from the following description taken in connection with the accompanying drawing which illustrates by way of example certain preferred embodiments which the invention may assume in practice and in which like reference characters refer to like or corresponding parts throughout the several views.

DETAILED DESCRIPTION OF THE PREFERRED EMBODIMENTS

Figure 2:
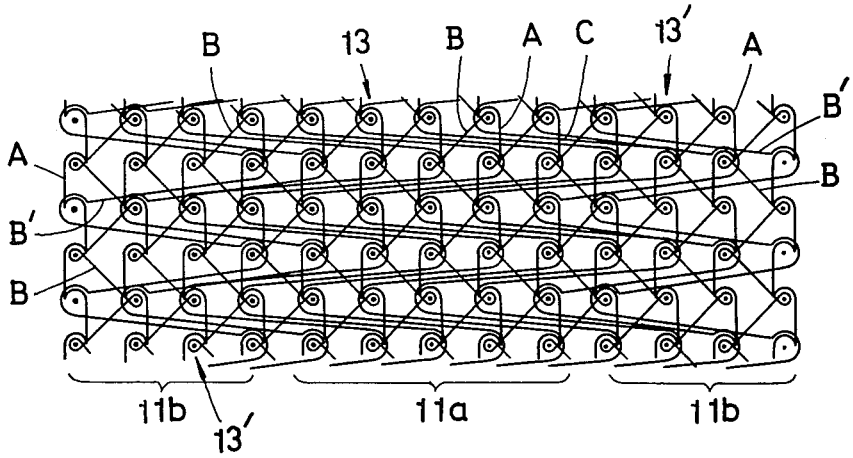
FIG. 2 is a diagram illustrating the knit construction of the stringer tape of FIG. 1.
Figure 3:
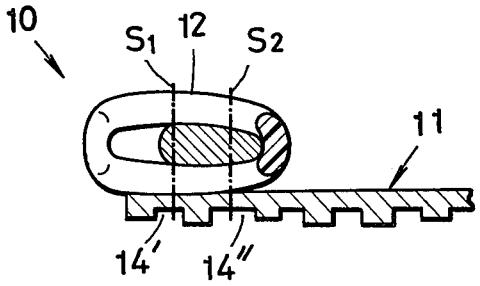
FIG. 3 is a transverse cross-sectional view of the stringer tape carrying a row of fastener elements by means of a double row of stitching.

Referring now to the drawing, and FIG. 3 in particular there is shown one of a pair of fastener stringers generally designated 10 which comprises a warp-knit support tape 11 and a row of relatively large interlocking fastener elements 12 mounted on the longitudinal edge of the tape 11. The support tape 11 consists of a warp-knit structure which has, as better shown in FIG. 2, a web portion **11*a* occupying a majority of the tape areas and a longitudinal edge portion 11*b* defining a selvage of the tape, both portions being interconnected transversely of the tape. The web portion 11*a* is formed by chain stitches A, defining a multiplicity of longitudinal wales 13 aligned in parallel, tricot stitches B extending diagonally across and between two adjacent wales 13, and laid-in weft threads C extending over and connecting every four wales 13**.

The longitudinal edge portion **11*b* of the support tape 11 is formed solely by knit-loop forming threads; i.e. a chain stitch A, a first tricot stitch B spanning every two wales and a second tricot stitch B′ spanning every four wales. The knit system of this tape portion is thus rendered rigid enough to anchor the fastener elements 12** stably into position thereon with uniform strength, irrespective as to whether the elements are mounted on the courses or not.

Figure 1:
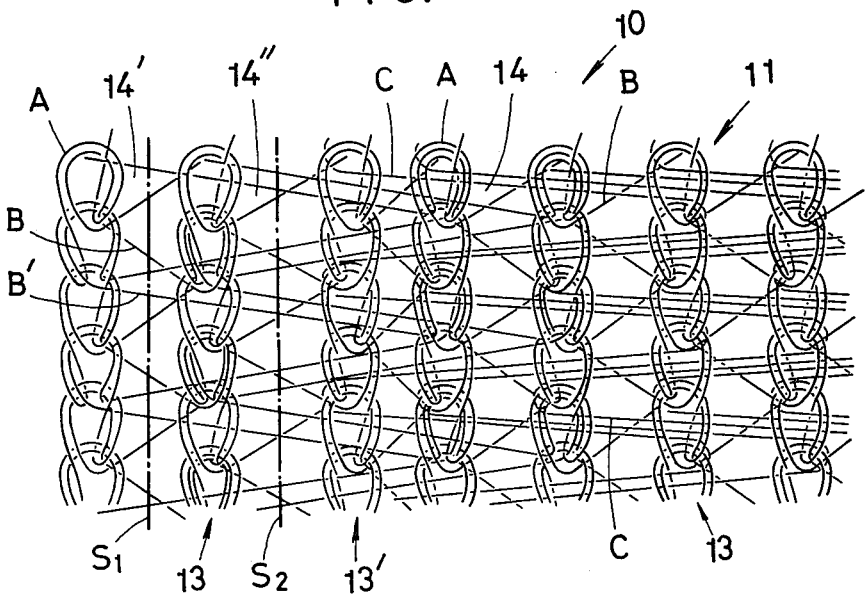
FIG. 1 is a diagrammatic fragmentary view on enlarged scale of a fastener stringer tape embodying the invention.

The wales 13 alternate transversely with interwale grooves or valleys 14 the second one of which counting from either extreme edge and designated at 14″ is widened by biasing the third wale 13′ toward the center or web portion of the tape. This is accomplished by the tension of lapping movement of the laid-in weft threads C around the third wale 13′ which is formed by chain stitches A and first tricot stitches B in the absence of second tricot stitches B′. As shown in FIGS. 1 and 3, the thus widened valley 14″ serves to admit therethrough the passage of the second line of stitching $S_2$ which would otherwise be obstructed by the third wale 13′ if the valley 14″ was narrow. The first line of stitching $S_1$ is introduced into the first interwale valley 14′ as shown. These two lines of stitching can anchor a row of relatively large fastener elements 12 into position against displacement under any extreme stresses.

Figure 4:
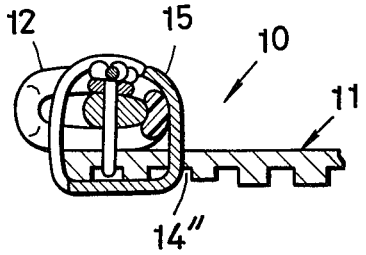
FIG. 4 is a transverse cross-sectional view of the fastener stringer having attached thereto a top end stop.
Figure 5:
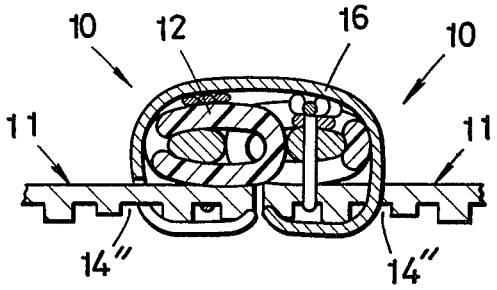
FIG. 5 is a transverse cross-sectional view of a pair of these stringers having attached thereto a bottom end stop.

The provision of the widened valley 14″ adjacent the tape edge has a further advantage in that a staple-like top end stop 15 shown in FIG. 4 as well as a bottom end stop 16 mounted astride the confronting edges of a pair of stringers 10 can be applied to a respective tape end in a manner desired to grip and anchor the terminal fastener elements 12 because the end stops 15 and 16 can be guided through respective widened valleys 14'' without coming into thrusting contact with the third wales 13' or damaging the knit fabric thereat.

What is claimed is:

1. A fastener stringer which comprises a warp-knit tape and a row of interlocking fastener elements secured thereto, said tape having a web portion formed by chain stitches defining longitudinally extending wales, tricot stitches extending diagonally across and between a plurality of adjacent wales, and laid-in weft threads extending over and connecting every four wales and a longitudinal edge portion defined solely by knit-loop forming threads, including chain stitches defining plural longitudinal wales, and two groups of tricot stitches, the tricot stitches of each group thereof spanning a different number of wales of said chain stitches in the longitudinal edge portion, both of said portions being interconnected transversely of the tape by threads constituting said web portion and said edge portion, respectively, one of said wales adjacent said longitudinal edge portion being biased toward said web portion to widen an interwale valley between said one of wales and its neighboring wale.

2. A fastener stringer as claimed in claim 1 wherein said interwale valley lies between the second and the third wale counting from an extreme edge of the tape.

3. A fastener stringer as claimed in claim 2 wherein said third wale is biased toward the center of the tape by the tension of laid-in weft threads lapping around said third wale.

* * * * *